US006428430B1

(12) United States Patent
Chong

(10) Patent No.: US 6,428,430 B1
(45) Date of Patent: Aug. 6, 2002

(54) RETRACTABLE BALL MARK REPAIR TOOL AND BALL MARKER

(76) Inventor: Catherine M. Chong, 8 Alder La., Avon, CT (US) 06001

( * ) Notice: Subject to any disclaimer, the term of this patent is extended or adjusted under 35 U.S.C. 154(b) by 0 days.

(21) Appl. No.: 09/545,204

(22) Filed: Apr. 7, 2000

Related U.S. Application Data

(60) Provisional application No. 60/128,200, filed on Apr. 7, 1999.

(51) Int. Cl.[7] ..... A63B 57/00

(52) U.S. Cl. ..... 473/408; 473/406

(58) Field of Search ..... 473/406, 405, 473/131, 408; 273/32; 172/378; D21/793; 30/162, 163, 159

(56) References Cited

U.S. PATENT DOCUMENTS

| | | | |
|---|---|---|---|
| 3,539,017 | A | 11/1970 | Johnson |
| D238,436 | S | 1/1976 | McKelvey |
| 4,063,731 | A | 12/1977 | Kitay |
| 4,386,774 | A | 6/1983 | Buckman |
| 4,627,621 | A | 12/1986 | Tate |
| 4,856,132 | A | 8/1989 | Burns et al. |
| D306,057 | S | 2/1990 | Vaughan, Jr. |
| 4,955,609 | A | 9/1990 | Kassen |
| 4,998,726 | A | 3/1991 | Budnick |
| 5,143,371 | A | 9/1992 | Strahan |
| 5,226,647 | A | 7/1993 | Notarmuzi |
| 5,292,120 | A | 3/1994 | Pehoski et al. |
| 5,305,999 | A | 4/1994 | Tate |
| 5,388,824 | A | 2/1995 | Reimers |
| 5,393,052 | A | 2/1995 | Kennedy |
| 5,409,212 | A | 4/1995 | Arnett |
| D361,815 | S | 8/1995 | Fazekas |
| 5,449,169 | A | 9/1995 | Hardin et al. |
| 5,529,299 | A | 6/1996 | Bellagamba |
| 5,562,553 | A | 10/1996 | Digerness et al. |
| D387,409 | S | 12/1997 | Cole, Jr. |
| 5,733,208 | A | 3/1998 | Fazekas |
| 5,788,197 | A | 8/1998 | Tutela |
| 5,853,336 | A | 12/1998 | Hufgard |
| D406,297 | S | 3/1999 | Fazekas |
| D409,705 | S | 5/1999 | Fazekas |
| 6,062,992 | A * | 5/2000 | Hoyt et al. |

* cited by examiner

*Primary Examiner*—Paul T. Sewell
*Assistant Examiner*—Nini Legesse
(74) *Attorney, Agent, or Firm*—Bachman & Lapointe, P.C.

(57) ABSTRACT

A ball-mark repair tool, includes a housing having a longitudinal slot and an open end; a repair tool having an operative end and being slidably positioned in the housing for sliding along a path between a withdrawn position and an extending position, the operative end extending from the open end of said housing in the extending position; a latch member associated with the repair tool for sliding along the path with the repair tool and extending through said slot for manually moving the repair tool, the latch member further being positionable, when the repair tool is in the extending position, between a latching position wherein the repair tool is held in the extending position and a released position wherein the repair tool can be moved along the path to said withdrawn position.

17 Claims, 12 Drawing Sheets

RETRACTABLE BALL MARK REPAIR TOOL AND BALL MARKER

This application claims priority from Provisional application Ser. No. 60/128,200, filed Apr. 7, 1999.

BACKGROUND OF THE INVENTION

The object of this invention is to improve upon the multi-functional golf accessory. It will provide a combination of tools in a small housing which can easily be carried by a user in a pocket.

SUMMARY OF THE INVENTION

In accordance with the present invention, the foregoing object has been readily attained.

According to the invention, a ball-mark repair tool is provided, which tool comprises a housing having a longitudinal slot and an open end; a repair tool having an operative end and being slidably positioned in the housing for sliding along a path between a withdrawn position and an extending position, the operative end extending from the open end of said housing in the extending position; a latch member associated with the repair tool for sliding along the path with the repair tool and extending through said slot for manually moving the repair tool, the latch member further being positionable, when the repair tool is in the extending position, between a latching position wherein the repair tool is held in the extending position and a released position wherein the repair tool can be moved along the path to said withdrawn position.

BRIEF DESCRIPTION OF THE DRAWINGS

A detailed description of preferred embodiments of the present invention follows, with reference to the attached drawings, wherein.

DESCRIPTION OF THE PREFERRED EMBODIMENT

With reference to the enclosed drawings, FIGS. 1–8, disclose one embodiment of a new and improved retractable ball mark repair tool or apparatus 25 and design of same, and FIGS. 9–18 illustrate another embodiment. The device is useful, for example, for repairing ball marks and other marks on a golf green, and may have numerous other uses including but limited to spike cleaning and the like.

Figure 1:
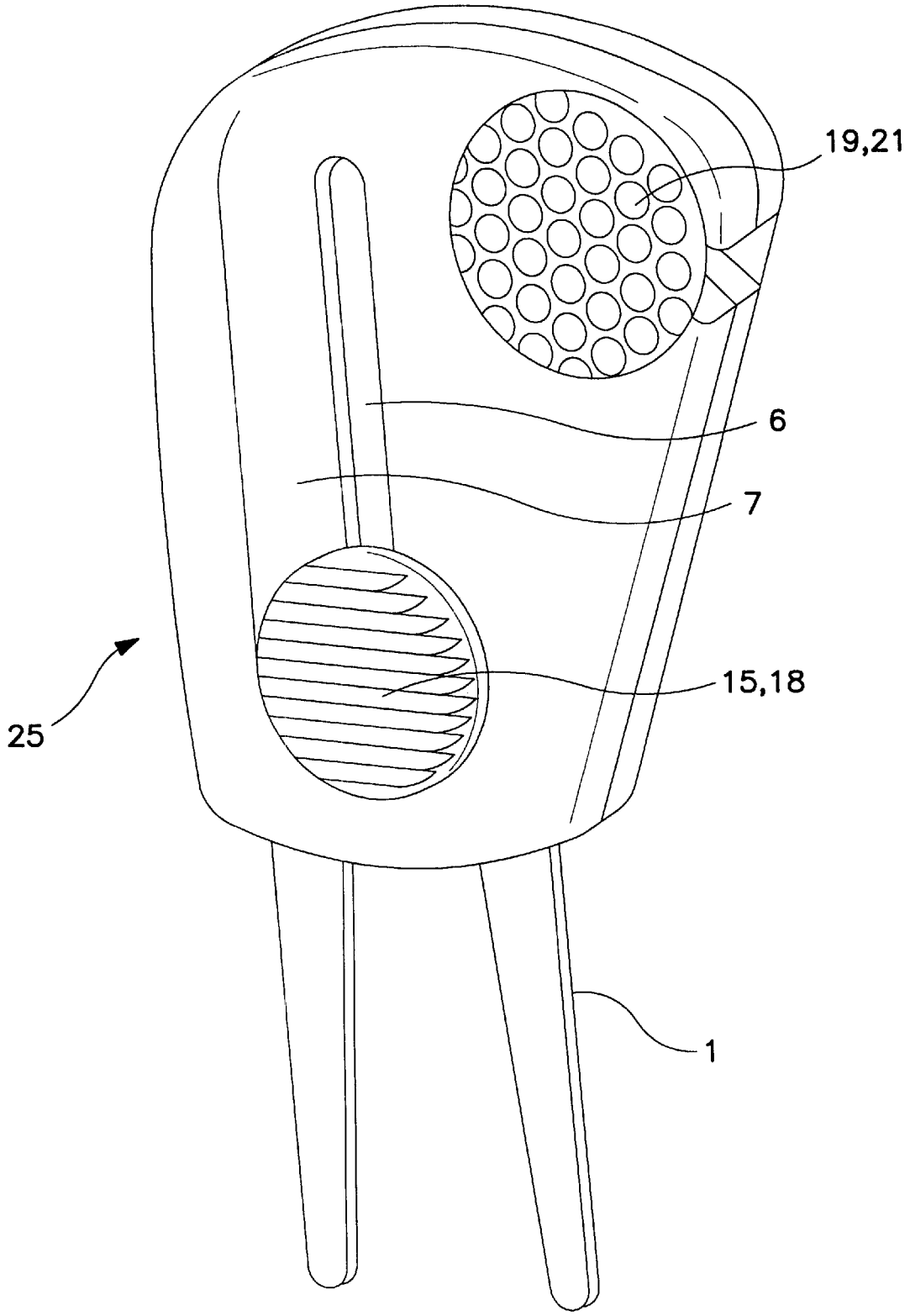
FIG. 1 is a perspective view of a top portion of an apparatus according to the invention.
Figure 1A:
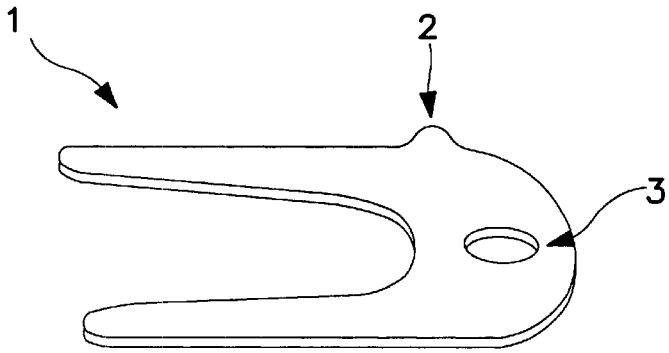
FIG. 1*a*–1*e* are perspective views of various components of the apparatus.
Figure 1B:
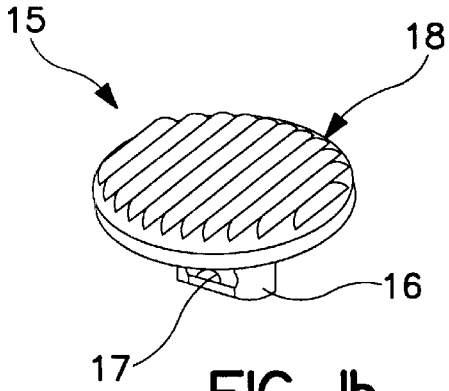
Figure 1C:
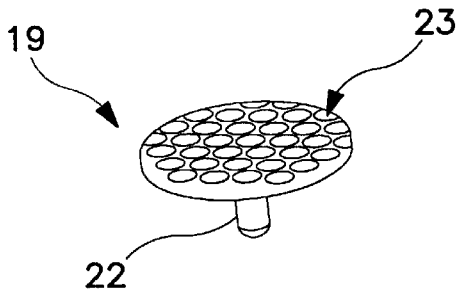
Figure 1D:
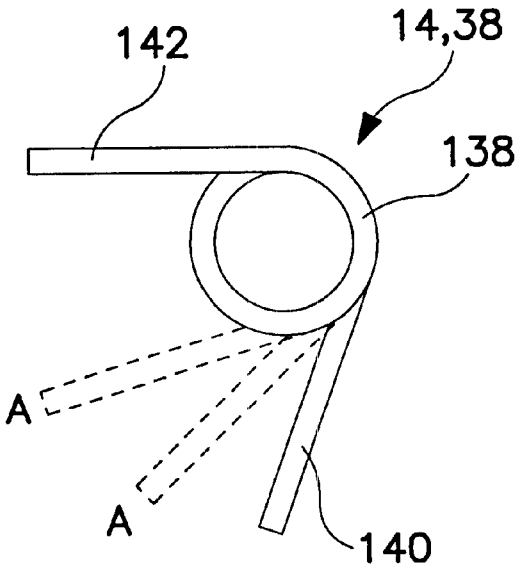
Figure 1E:
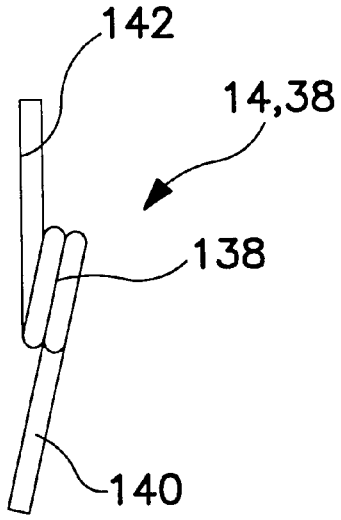

The present invention is a system, FIG. 1, consisting of a plurality of components which may include a tool 1 (FIG. 1*a*), a housing 26 (FIGS. 3–4), a spring 14 (FIGS. 1*d*–1*e*), a button 15 (FIG. 1*b*) and a marker 19 (FIG. 1*e*). Referring now to FIGS. 9–17, an alternative embodiment in accordance with the present invention will be described.

Various components of the present invention may be referred to herein as distal or proximal. These terms are used with reference to the tool with prongs extended as held by a user. Thus, a distal orientation is one relatively closer toward the extending tool portion, while a proximal orientation is one relatively closer toward the handle portion.

The tool 1 is made of a rigid material, either metal or plastic. It is of a fork-like configuration consisting of two laterally spaced tines or prongs. The tool is stored within the housing in its retracted position. One prong arm can have a raised protuberance 2 that functions as part of the locking mechanism with the pin on the interior of the housing. The proximal end contains an aperture 3 which will secure it to the button.

When the tool is extended the body of the device is used as a handle, increasing the leverage. It can also be inserted in the ground to function as a club holder, preventing club grips from becoming wet.

Figure 2:
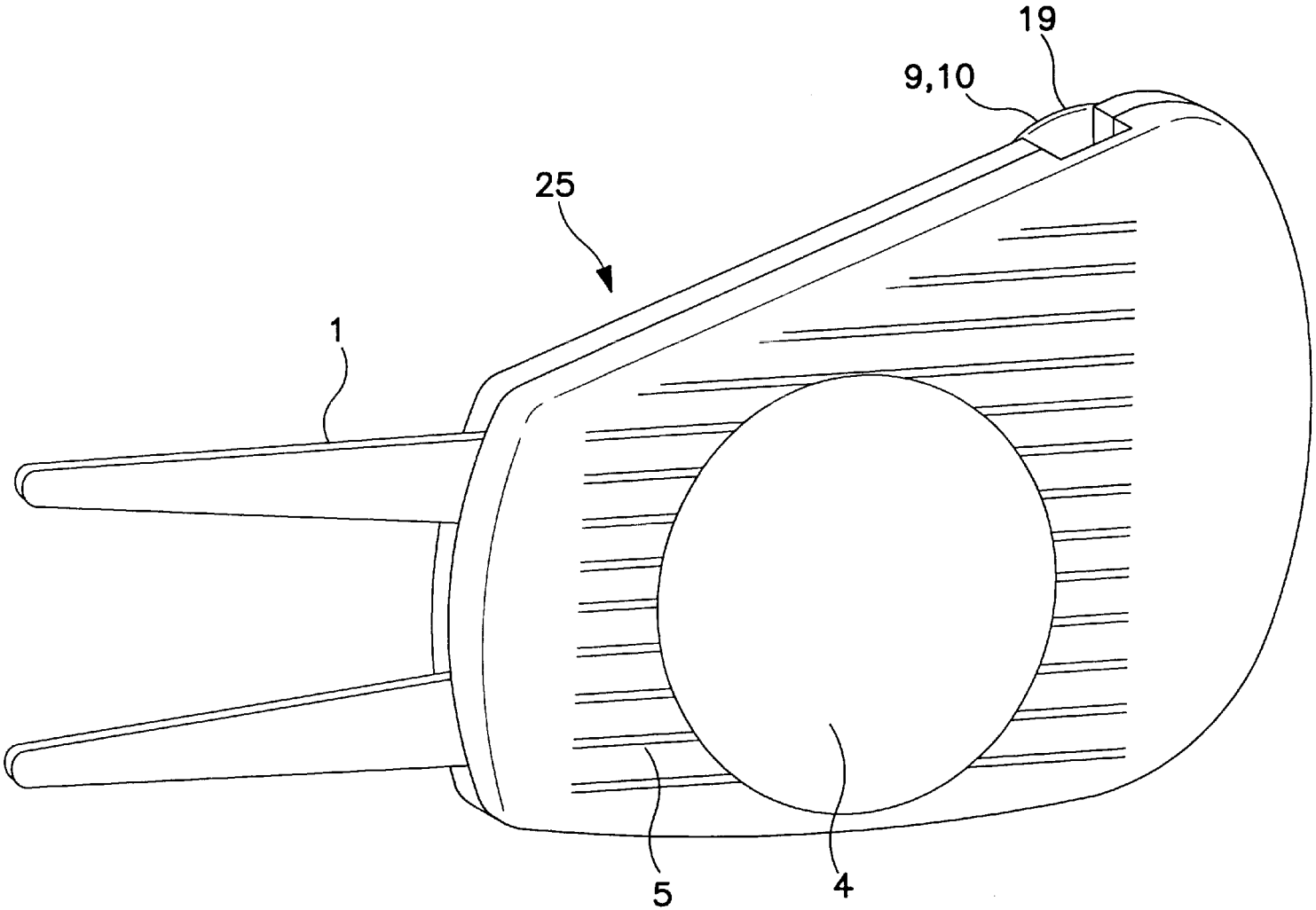
FIG. 2 is a perspective view of a bottom portion of an apparatus in accordance with the invention.

The housing 26, FIGS. 1–2, features a unique design that is made to look like a golf club iron head. Alternate embodiments include mirror images of the club head. Additional embodiments include tools that look like other golf equipment such as the driver, fairway woods, golf balls and tees.

The housing 26 can be made of either metal or plastic. The plastic version is preferred and may be manufactured using double injected molding technique so as to provide relatively soft plastic over harder plastic in its manufacture to give a unique and ergonomic soft grip feeling on the housing, the button and the like.

Figure 3:
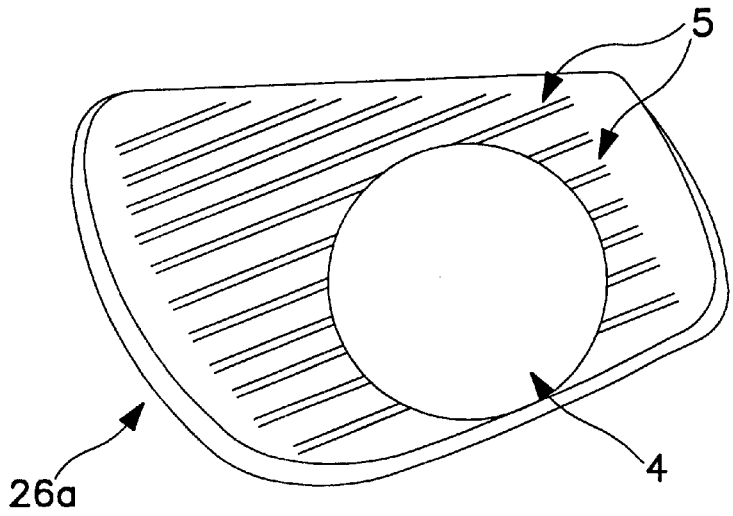
FIG. 3 is a perspective view of an outside surface of a bottom housing portion.
Figure 4:
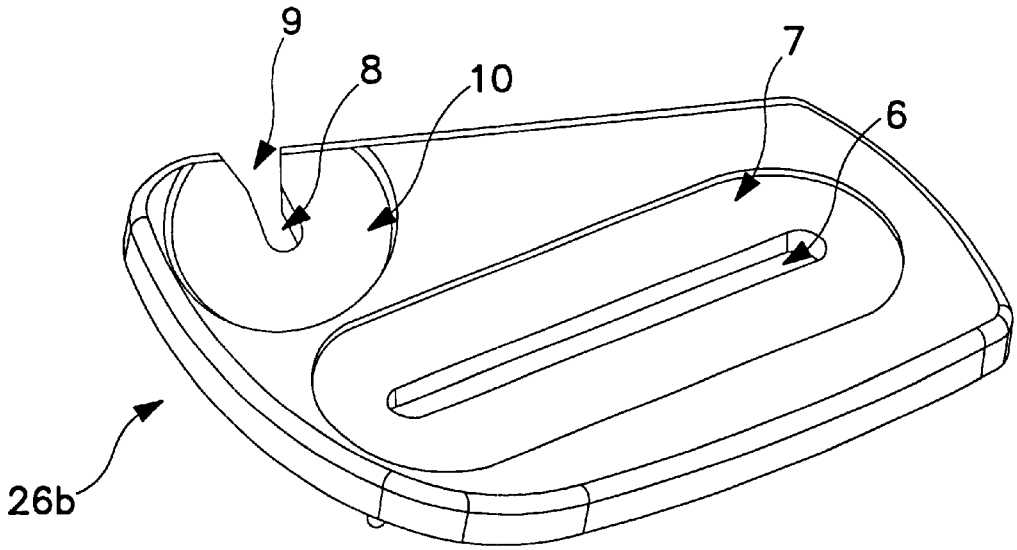
FIG. 4 is a perspective view of an outside surface of a top housing portion.

The housing includes a bottom half 26*a* and a top half 26*b* FIGS. 3–4, with openings to allow the tool to be extended. The bottom half 26*a*, FIG. 3, is suitable for placement of indicia 4 and other advertising messages. This can be done in any design shape, the circle is merely indicated as an example. The present design also shows a series of lines to imitate the grooves 5 of a club head. Additional embodiments include the distinctive use of holographic designs on the housing as well as on the marker 19.

The top half of the housing 26*b*, FIG. 4, contains a longitudinal slot 6 extending along the majority of the body through which the button 15 can slide. There are also recessed tracks 7 forming an oval perimeter around the slot, preferably the size of the button, in order to provide tracking guidance for button 15. In addition, the top half 26*b* also preferably contains a short longitudinal slot 8 with which to hold the central stem of a ball marker. The slot is slightly wider at the outer edge 9 of the housing to allow for the ease of sliding the marker in and out. There are also recessed tracks 10 forming a perimeter around the slot, the size of the marker.

Figure 5:
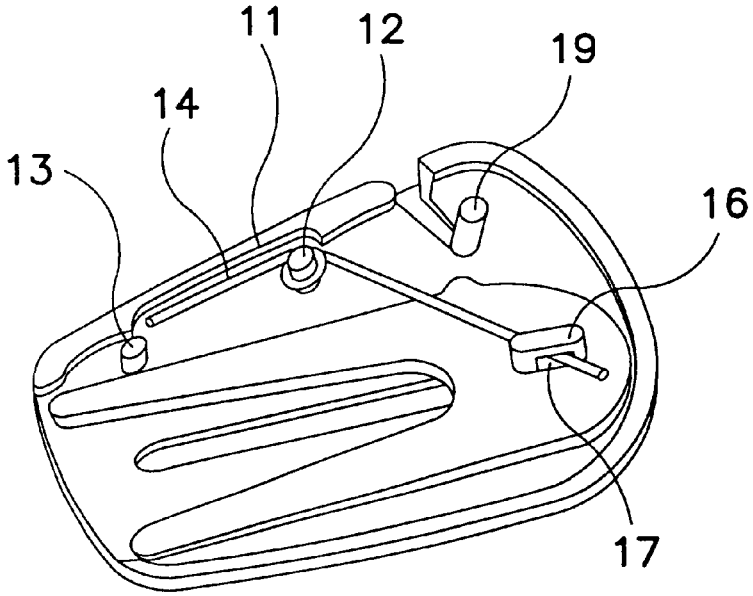
FIGS. 5 and 6 illustrate an interior of the apparatus of the present invention.

The interior of the top half 26*b* of the housing, FIG. 5, has a recessed slot on the perimeter wall 11 the size of the spring arm in order to keep it in place. There are also two pins 12, 13 extending perpendicularly and touching the interior of the bottom half 26*a*. The first pin 12 is used for placement of the spring. When the housing is made of a more rigid plastic or metal, one preferred embodiment shows the second pin 13 being used as a part of the locking mechanism in conjunction with the raised protuberance on the tool. It may be made of a more flexible material than the outer wall of the housing providing enough resistance to allow the protuberance on the tool to be pushed past the pin with the pressure of the thumb thereby locking the tool in the operative position. The tool is then released back to the retracted position by the pressure of the thumb pushing the button backwards. The size and placement of both the pin and the protuberance of the tool can vary depending on the type of materials used. It can be placed on any surface which the tool passes while it is being extended to the operative position. Examples of alternate embodiments, FIGS. 7*a*, and *b* show a raised protuberance 20 in the longitudinal slot where the button slides which provides a resistance with the interior projection of the button when pushed forward (there is no raised protuberance on the tool) and by the use of the outer wall of the housing (21) to provide a resistance for the raised protuberance on the tool (a second pin is not required).

The torsion spring 14, (FIGS. 1*d*–*e*) is generally a coil with two ends extending outward. Design specifications of the spring, which include the material, diameter, thickness and length of the coil and the spring arms, will vary according to whatever tension is required and by the materials used for the housing and tool. Special types of torsion springs may include double torsion springs and springs having a space between the coils to minimize friction.

Figure 1F:
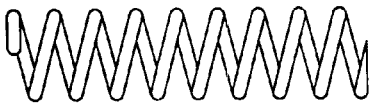
FIG. 1f PRIOR ART
FIG. 1*f* and 1*g* are prior art illustrations of a conventional compression spring.
Figure 1G:
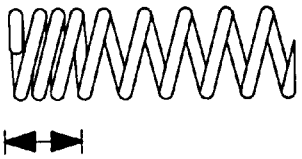
FIG. 1g PRIOR ART

The use of the torsion spring is a new and improved design in a retractable ball and repair tool. Torsion springs, whose ends are rotated in angular deflection, offer consistent resistance to externally applied torque. This provides a more efficient use of applied pressure than other tools which use the compression coil. A compression spring (FIG. 1*f* and FIG. 1*g*) cannot be made so consistently that its end coils will not have uniform configuration and closing tension. Consequently, these springs cannot be coiled so accurately as to permit all coils to close out simultaneously when they are compressed. As a result, the spring rate tends to lag over the initial application of pressure by the user and so does not provide a consistent resistance.

Figure 6:
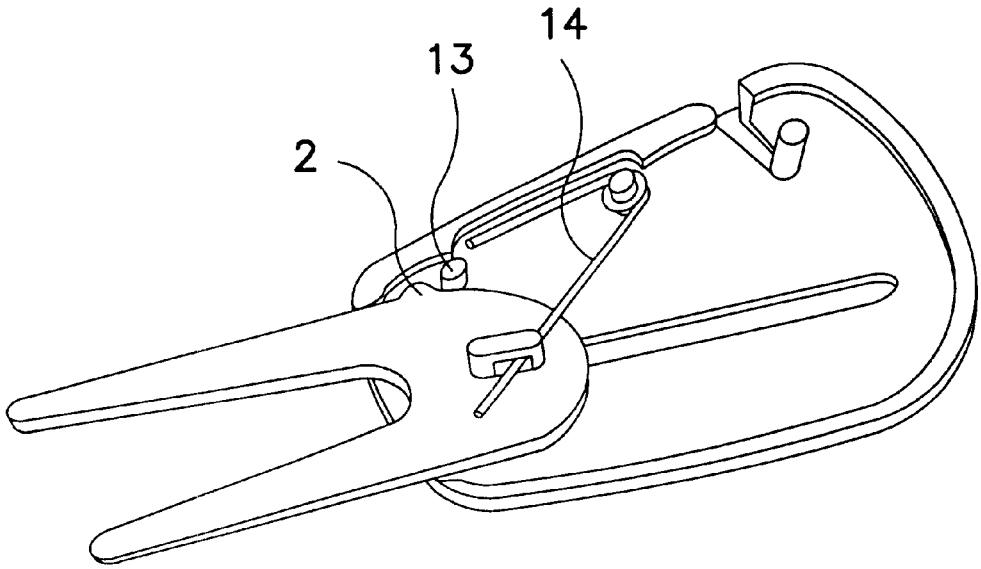
Figure 7A:
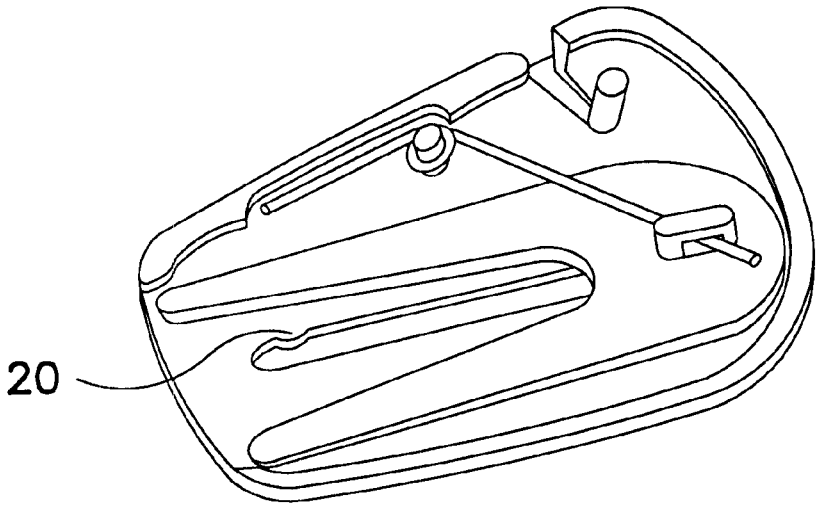
FIGS. 7*a* and 7*b* illustrate alternative embodiments of the present invention.
Figure 7B:
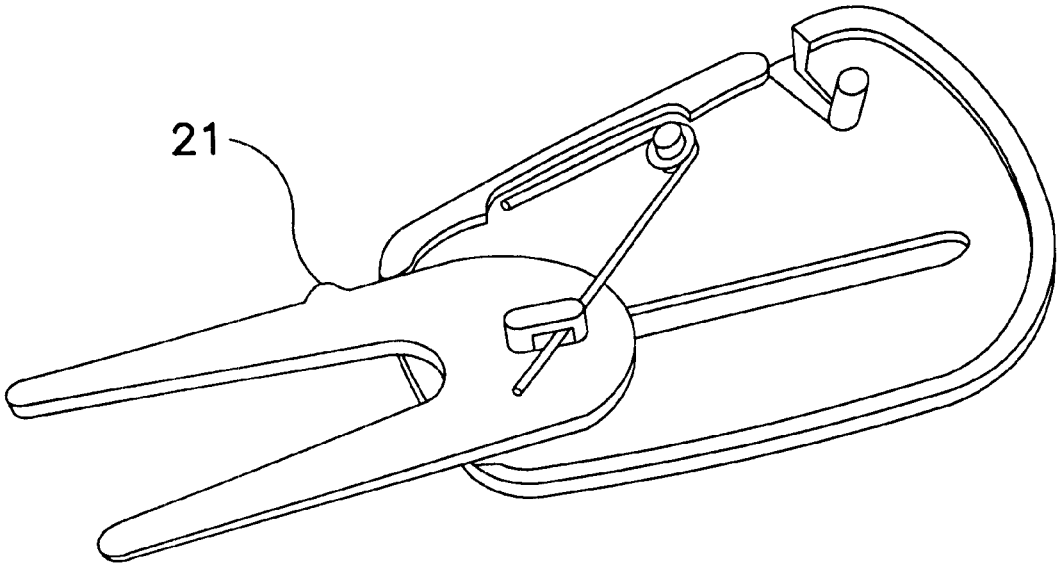

One preferred embodiment, FIGS. 5–6, shows a single torsion spring with the coil wrapped around pin 12 in the interior of the housing. One spring arm rests on the perimeter of the housing and the other spring arm extends through the aperture 17 of the button 15. The spring is compressed as the tool is extended, FIG. 6. It can then be held in place at its furthest extension with the locking mechanism and then released back to its position with a gentle push of the thumb. The spring has no tension in the retracted position. Alternate embodiments include a spring that is positioned in the reverse manner, where the spring is at its greatest tension in the retracted position and is extended with the push of the button as well as the use of alternate types of torsion springs such as the double torsion springs and springs having a space between the coils to minimize friction.

The button 15 has an in interior projection 16 (FIG. 1*b*) that is secured to the aperture 3 of the tool 1. The interior projection also contains its own aperture (17) to receive one end of the spring. The top half of the button (18) is textured and contoured in order to provide a better feel on the thumb for the user. The plastic version of the button preferably features the use of double molded injection technique in its manufacture to further add a soft and ergonomic texture.

The marker 19 is typically a flat circular body which may have a central stem 22 made of either metal or plastic. The stem can easily glide in and out of the short longitudinal slot 8 on the top half of the housing for easy access to the golfer. The top 23 is suitable for placement of indicia and other advertising messages. The present illustration shows a series of indented circles made to look like the dimples of a golf ball, although other embodiments include the distinctive use of holographic designs on the marker, and the like.

Figure 8A:
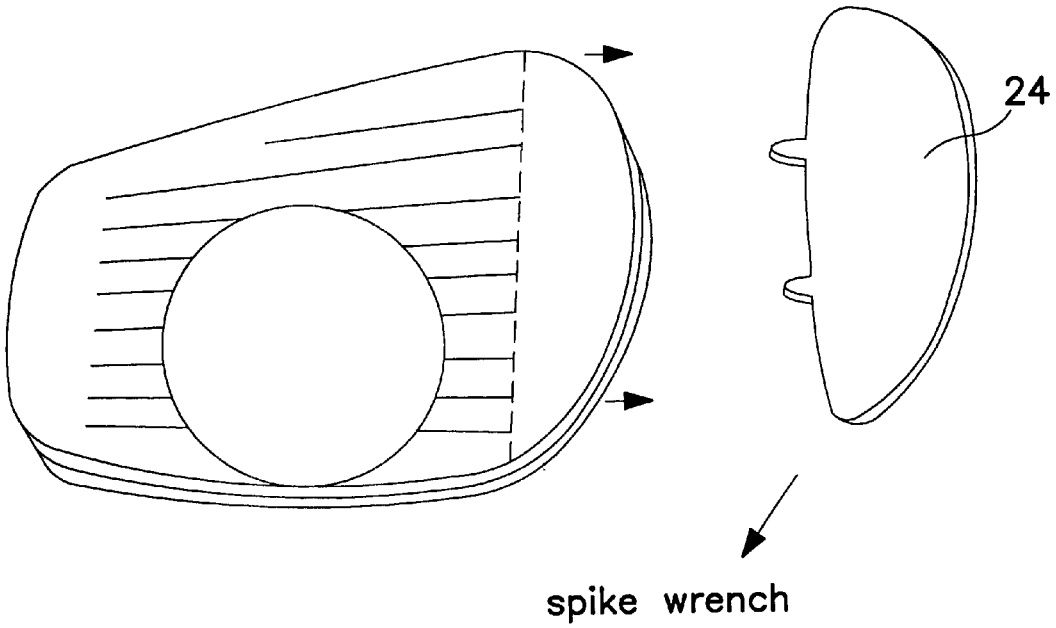
FIGS. 8*a* and 8*b* illustrate further alternative embodiments in accordance with the present invention.
Figure 8B:
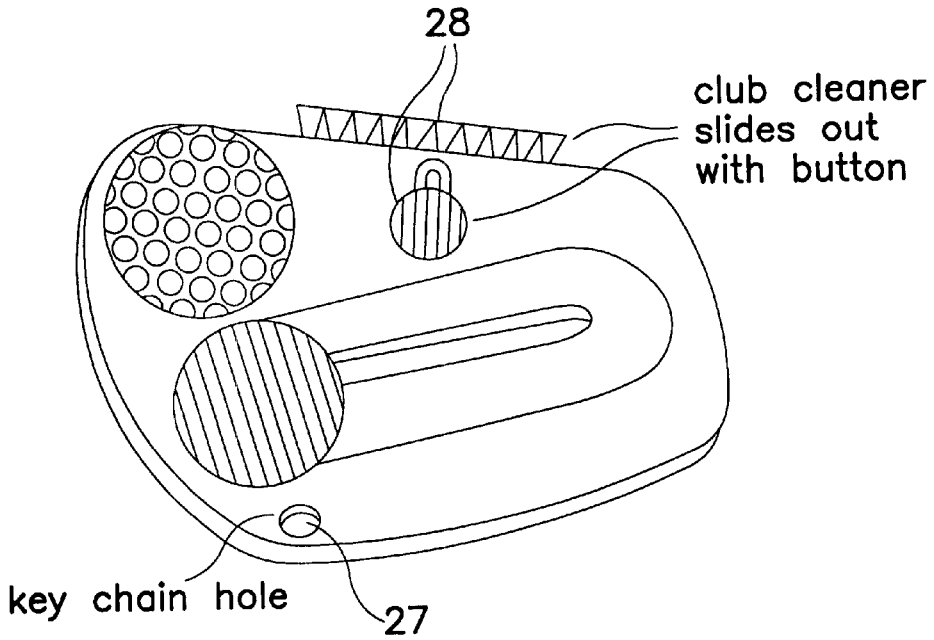

Alternate embodiments of the tool include a spike wrench 24 (FIG. 8*a*), a key chain hole 27 and club cleaner 28, (FIG. 8*b*). Referring now to FIGS. 9–18, several additional embodiments of the present invention are disclosed.

Figure 9:
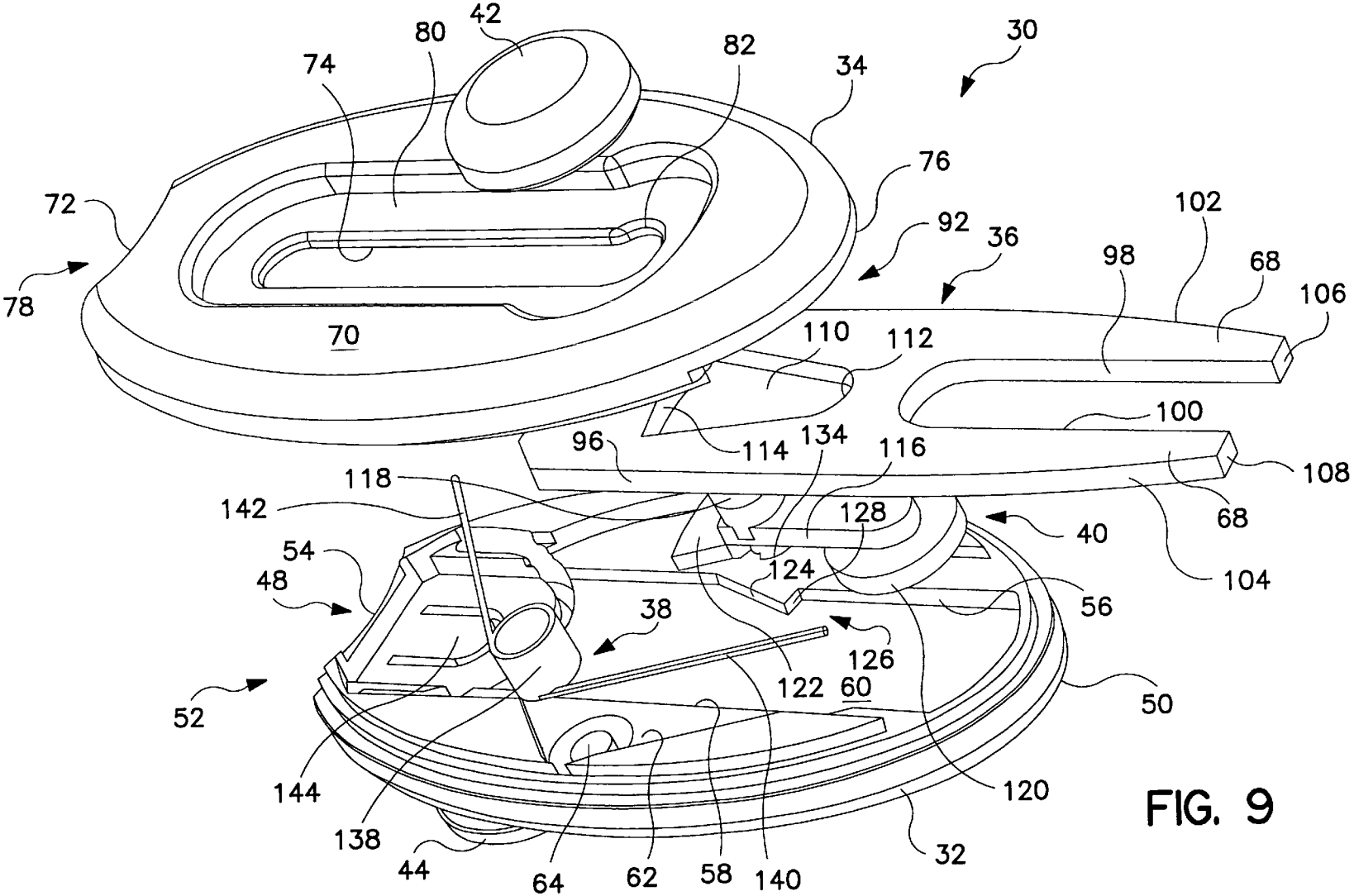
FIG. 9 and 10 are perspective exploded views of another embodiment in accordance with the present invention.

FIG. 9 shows perspective exploded views of a repair tool 30 in accordance with an alternative embodiment of the invention which, like the embodiments of FIGS. 1–8, preferably includes housing portions 32, 34, a tool or tool blade 36 having an operative end, for example prongs 68 for repairing ball marks, a spring 38 for biasing tool blade 36 as desired, and a latch member 40 which is useful in guiding and latching tool blade 36 as desired and as will be discussed below.

In addition, repair tool 30 includes a button 42 connected to latch member 40 and accessible from outside of housing 32, 34 for use in operating repair tool 30, and storage area for storing a ball marker 44 and the like.

Figure 10:
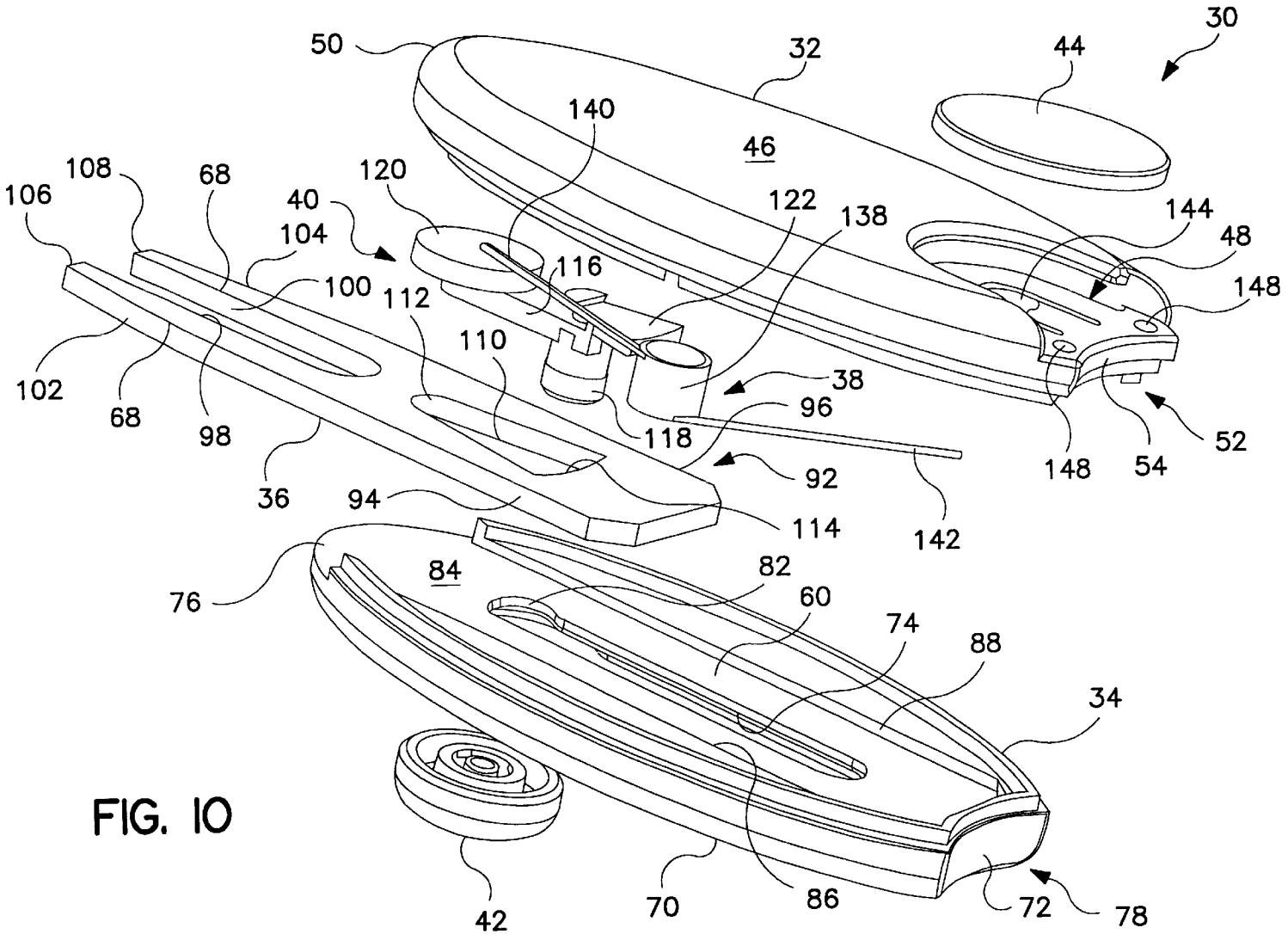
Figure 11:
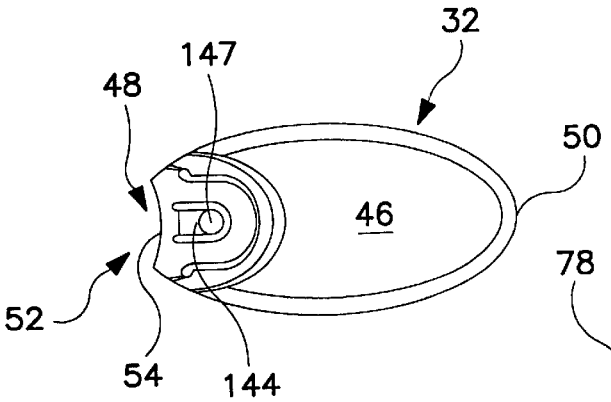
FIGS. 11 and 12 illustrate outside and inside surfaces of one housing half of the embodiment of FIG. 9.
Figure 12:
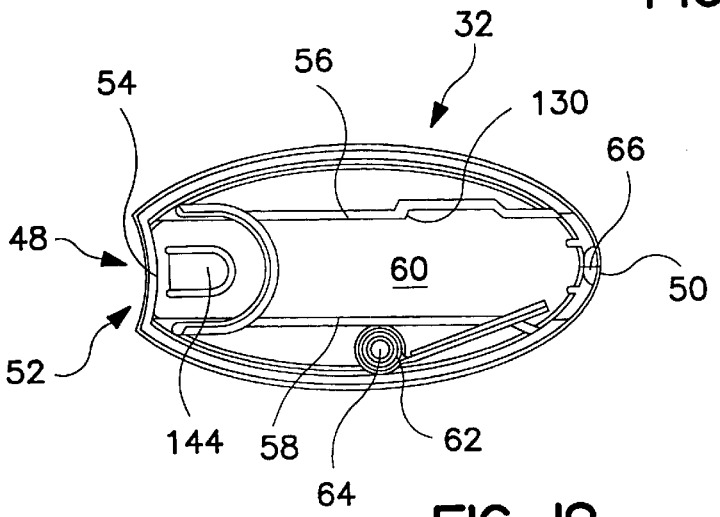

Referring also to FIGS. 11 and 12, housing portion 32 is more thoroughly described. FIG. 11 shows an outer surface 46 of housing portion 32 which, in this embodiment, is generally oval-shaped and has a generally smooth area which is excellent for use, if desired, in displaying various indicia and the like. Housing portion 32 is also preferably provided having a receptacle 48 for holding ball marker 44 as will be more thoroughly discussed below. Still further, and as illustrated in FIGS. 9 and 10, housing portion 32 has an end 50 corresponding to the position of tool blade 36 and an opposite end 52 which is preferably provided with a concave surface 54 such that repair tool 30 can advantageously be positioned with tool blade 36 firmly embedded in the ground so as to position concave surface 54 for use as a support, for example for the handle of a golf club.

Outer surface 46 of repair tool 30 in accordance with the present invention may advantageously be provided having a softer material on an exterior surface, with a harder or more rigid material on the inner surface, for example through injection molding techniques as described above, so as to provide repair tool 30 with a better "feel".

FIG. 12 shows an inside surface of housing portion 32 including tracks 56, 58 which define a path 60 along which tool blade 36 travels when moved between a withdrawn and an operative position. Housing portion 32 also preferably includes a recessed area 62 for receiving a portion of spring 38, and a post 64 around which spring 38 can be positioned. Housing portion 32 may be provided having a stop member 66 positioned to slide between prongs 68 of tool blade 36 when tool blade 36 is extended from housing 32, 34.

Figure 13:
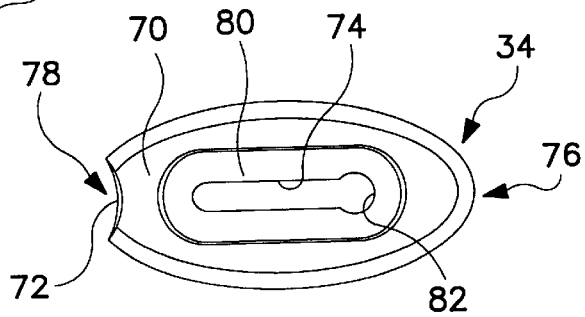
FIGS. 13 and 14 illustrate inside and outside surfaces of the other housing half of the embodiment of FIG. 9.
Figure 14:
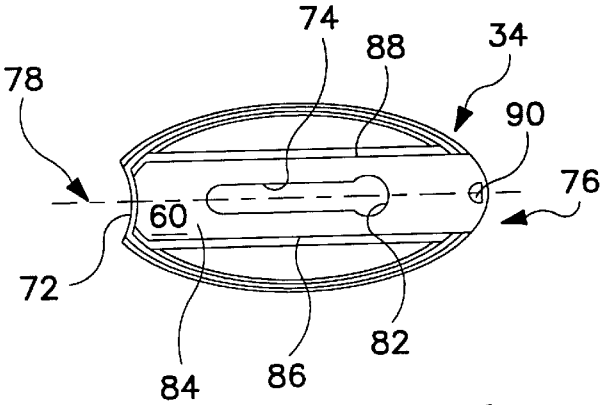

Referring now to FIGS. 13 and 14, housing portion 34 is more thoroughly described. As shown, housing portion 34 has an outer surface 70 which is also preferably provided as a substantially smooth surface which may be manufactured so as to provide advantageous feel as described above. Housing portion 34 also preferably has a generally oval-shape as with housing portion 32 such that housing portions 32, 34 can be mated and assembled to enclose the other components of repair tool 30 as desired. In addition, housing portion 34 also preferably includes a concave surface 72 at one end which matches concave surface 54 of housing portion 32 for use as described above. Outer surface 70 is also preferably provided having a slot 74 which is oriented longitudinally on housing portion 34 and extends a distance aligned between open end 76 and opposite end 78. A recessed or inset area 80 can be disposed around slot 74. Recessed area 80 advantageously defines an inset track in which button 42 can move during operation of repair tool 30 as desired. Slot 74 may also advantageously have an enlarged or rounded end 82, preferably at the distal end of slot 74 which is closest to open end 76.

Referring to FIG. 14, an inner surface 84 of housing portion 34 is illustrated and also preferably includes track members 86, 88 which serve to further define path 60 along which tool blade 36 travels during opening and closing of repair tool 30 as desired. Housing portion 34 also preferably includes a receptacle 90 which may be shaped and positioned to receive stop member 66 of housing portion 32 to provide additional stability and structural strength to housing 32, 34 when assembled.

Referring back to FIGS. 9 and 10, it is readily apparent that housing portions 32, 34 are assembled with tool blade 36, latch member 40 and spring 38 positioned therebetween so as to operatively assemble repair tool 30 as desired. When assembled, button 42 can advantageously be used to slide tool blade 36 between a withdrawn position wherein tool blade 36 is substantially enclosed within housing portions 32, 34, and an extended position wherein tool blade 36 extends from housing portions 32, 34 for use as desired.

Figure 15:
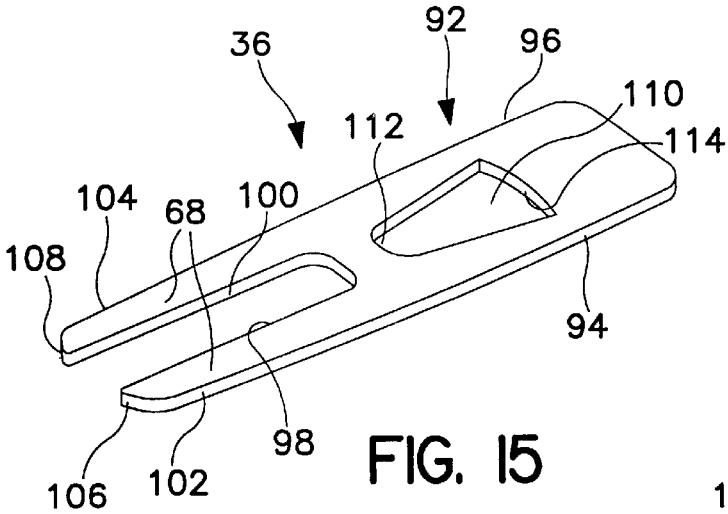
FIG. 15 is a perspective view of the tool element of the embodiment of FIG. 9.

Referring now to FIG. 15, details of a preferred embodiment of tool blade 36 are readily apparent. As shown, tool blade 36 preferably includes a body portion 92 which has substantially straight and parallel walls 94, 96 which are sized to slidably translate between track members 56, 58 and 86, 88 of housing 32, 34 for extending and withdrawing tool blade 36 as desired. Tool blade 36 may suitably be a substantially flat member, preferably made of a material having sufficient strength for use as intended. Tool blade 36 also includes prongs 68 which preferably extend substantially parallel as shown, and which are useful in repairing ball marks on a golf course. Prongs 68 may advantageously have substantially straight and parallel inner surfaces 98, 100 and may have outer surfaces 102, 104 which are gradually curved inwardly toward the distal end of tool blade 36 to form substantially rounded ends 106, 108. Still referring to FIGS. 9, 10 and 15, tool blade 36 also preferably includes a cutout 110 which is adapted to receive latch member 40 as will be further discussed below and to allow the desired range of motion of latch member 40 relative to tool blade 36, also as will be discussed below. As shown in FIG. 15, cutout 110 advantageously has a distal end 112 which is rounded to pivotably receive a portion of latch member 40 and a proximal end 114 which is spread laterally as shown to allow desired pivot of latch member 40 within cutout 110 around a pivot point defined at distal end 112.

Figure 16:
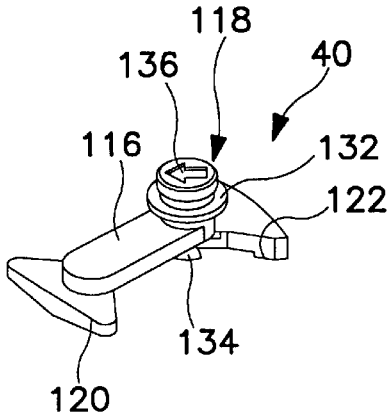
FIGS. 16–18 illustrate a latch member in accordance with the embodiment of FIG. 9.
Figure 17:
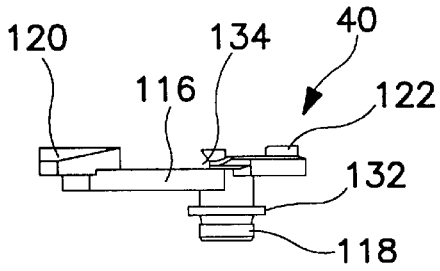
Figure 18:
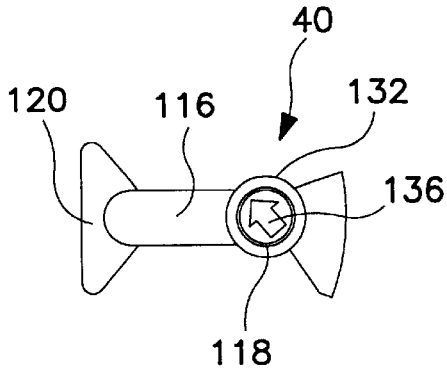

Referring now to FIGS. 16, 17 and 18 in addition to FIGS. 9 and 10, latch member 40 in accordance with the present invention is further described and illustrated. Latch member 40 in accordance with the present invention preferably includes a body portion 116 which is adapted to fit within cutout 110 of tool blade 36, and which further has an extending member 118 which advantageously is positioned extending through slot 74 for use in manipulating tool blade 36 and the latch member 40 as desired. Latch member 40 also preferably includes a guide or flange member 120 which is adapted to extend beyond the profile of cutout 110 of tool blade 36 so as to support latch member 40 relative to tool blade 36. In the embodiment of FIGS. 9 and 10, flange member 120 has a substantially rounded shape, while in the embodiment of FIGS. 16–18, flange member 120 has a substantially triangular shape. It should of course be appreciated that other shapes and sizes of flange member 120 are acceptable in accordance with the present invention.

Latch member 40 also preferably includes a lug or tail portion 122 which is adapted and positioned to be selectively engageable with apportion of housing 32, 34 so as to lock latch member 40 and accompanying tool blade 36 in an extended position when desired. In FIGS. 9 and 10, tail 122 of latch member 40 is a flared flange which is adapted to slide over a long slope 124 of a protrusion 126 disposed in housing portion 32. Protrusion 126 also has a stop surface 128 against which tail member 122 of latch member 40 engages in a latched position. To release latch member 40 and thereby withdraw tool blade 36 into housing 32, 34, button 42 and connected latch member 40 are preferably laterally moved so as to disengage tail 122 from stop surface 128 and thereby allow rearward or inward movement of tool blade 36 and latch member 40 into housing 32, 34 as desired.

Referring to the embodiments of FIGS. 16–18, and the drawing of housing portion 32 in FIG. 12, lug 122 is shown as a downwardly extending portion which advantageously travels along track 56 of housing portion 32. As shown in FIG. 12, track 56 preferably has a setback portion or other structure defining a surface 130 against which lug 122 engages so as to hold latch member 40 in the extended position and thereby hold tool blade 36 against rearward displacement. This functions in a latching and un-latching capacity in a similar manner to the embodiment of FIGS. 9 and 10.

Still referring to FIGS. 16–18, latch member 40 also preferably includes an additional flange 132 which is spaced from flange member 120 and sized to fit through rounded end 82 of slot 74, while extending wider than the width of the remaining portion of slot 74. This advantageously allows for latch member 40 to slidably hold latch member 40, tool blade 36 and housing portion 32 in an assembled position, thereby lending stability and smooth operation to repair tool 30 in accordance with the present invention.

Still referring to FIGS. 9, 10 and 16–18, latch member 40 also preferably includes a spring receptacle 134 which advantageously defines a notch for receiving an arm of spring 38 so as to provide desired operation of repair tool 30.

Latch member 40 or button 42 may advantageously be provided with indicia to advise a user of repair tool 30 of the direction in which to laterally move button 42 and latch member 40 so as to disengage or un-latch same. This indicia is shown in FIGS. 16 and 18 as an inset arrow shape 136. Of course, other types of indicia are acceptable.

Referring back to FIGS. 9 and 10, spring member 38 in accordance with the present invention advantageously includes a coiled portion 138 and extending arms 140, 142. One arm 140 is advantageously fixedly disposed into receptacle 62 of housing portion 32. The other arm 142 is advantageously engaged against spring receptacle 134 of latch member 40 and is advantageously adapted to apply a force to latch member 40 having two components. The first component advantageously urges tool blade 36 rearwardly into a withdrawn position, and is therefore a forced component aligned along a longitudinal axis of housing 32, 34. A second component of force applied by spring 38 onto latch member 40 advantageously urges latch member 40 laterally so as to engage against stop surface 128, 130 and thereby hold latch member 40 in a latched and extended position as desired. Button 42 which is advantageously connected to latch member 40, for example through member 118, can then advantageously be used to overcome the lateral force of spring 38, thereby disengaging latch member 40 from stop surface 128, 130, and allowing tool blade 36 to be withdrawn into housing 32, 34, advantageously with the withdrawing force of spring 38.

It should also be noted that, if desired, spring 38 could advantageously be positioned such that it applies the longitudinal force to tool blade 36 so as to urge tool blade 36 to an extending position, while still maintaining a lateral component of force applied by spring 38 to latch member 40 which serves to hold latch member 40 in a latched position. In this embodiment, simple locking structure would be desirable for holding blade 36 in the withdrawn position.

It should also be noted that spring 38 having a coiled portion 138 and arms 140, 142 is advantageous, as described above, in providing a substantially uniform force applied to latch member 40. This is particularly advantageous as compared to conventional coiled springs which may not provide desirable uniform force.

It should also be noted that button 42 can advantageously be any substantially rounded disk-shaped member that is readily attached or can form a part of latch member 40. In the embodiments of FIGS. 16–18, button 42 could advantageously be a ring that snaps over member 118. This is particularly advantageous during assembly of tool 30.

Referring back to FIGS. 9–12, a further description is provided regarding recessed area 48 for holding a ball marker 44. As shown, recessed area 48 may advantageously be formed as a semi-circular exterior opening slot into which ball marker 44 readily slides and is sized to fit. Advantageously, recessed area 48 advantageously includes a resiliently biased prong or contact member 144 which is formed so as to extend slightly into the path of a bail marker 44 positioned within recessed area 48. Contact member 144 thereby advantageously applies a lateral or upward holding force to ball marker 44 within recessed area 48 so as to hold ball marker 44 in place as desired, while allowing ball marker 44 to readily be removed for use.

Figure 20:
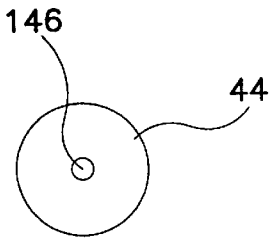
FIG. 20 shows a preferred embodiment of a ball marker according to the invention.
Figure 19:
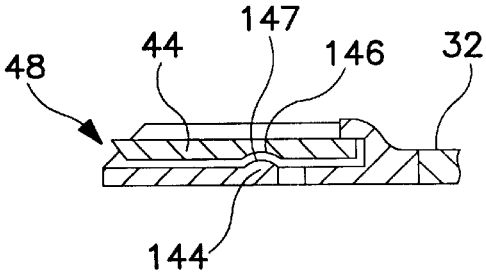
FIG. 19 is a side sectional view of a ball marker and holder according to the invention.

In accordance with a further aspect of the present invention, FIGS. 19 and 20 show ball marker 44 which is provided as a substantially disk-shaped member having at least one, preferably two opposed flat surfaces, and having an indentation 146 positioned on at least one surface.

In further accordance with this aspect of the present invention, contact member 144 may advantageously be provided having a protrusion 147 (see FIGS. 19) positioned to engage indentation 146 when ball marker 44 is disposed in slot or receptacle 48. This advantageously serves to firmly hold ball marker 44 in receptacle 48 as desired, while readily allowing ball marker 44 to be removed when desired. It should be noted that the receptacle and ball marker/ball holding structure as disclosed herein could readily be incorporated into other accessories such as key chains and the like.

In further accordance with the invention, and as shown in FIG. 10, receptacle 48 may further be provided with additional protruding members 148 positioned to contact against an edge of ball marker 44 when ball marker 44 is positioned within receptacle 48. Protrusions 148 are preferably positioned so as to abut against the exterior-facing edge of ball marker 44 to provide for more secure holding of ball marker 44, while nevertheless allowing ball marker 44 to be removed when desired.

Protruding member 147 on contact member 144 can be used in combination with or as an alternative with protruding members 148, as desired.

It should also be noted that while indentation 146 is shown substantially centered in ball marker 44 in FIG. 20, indentation 146 could readily be positioned elsewhere on ball marker 44 so long as indentation 146 and protruding member 147 are positioned to mate or engage when ball marker 44 is positioned as desired in receptacle 48.

It should be readily apparent that an apparatus has been provided which is useful while being simple and reliable in use and pleasing to a consumer, thereby accomplishing the objects of the invention.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A ball-mark repair tool, comprising:

a housing having a longitudinal slot and an open end;

a repair tool having an operative end and being slidably positioned in the housing for sliding along a path between a withdrawn position and an extending position, said operative end extending from said open end of said housing in said extending position;

a latch member associated with said repair tool for sliding along said path with said repair tool and extending through said slot for manually moving said repair tool, said latch member further being positionable, when said repair tool is in said extending position, between a latching position wherein said repair tool is held in said extending position and a released position wherein said repair tool can be moved along said path to said withdrawn position, wherein said repair tool defines a rounded pivot surface and said latch member contacts the rounded pivot surface so as to define a pivot point for said movement of said latch member relative to said repair tool.

2. A tool according to claim 1, further comprising a spring member disposed in said housing and applying a closing force for urging said repair tool toward said withdrawn position and applying a latching force for urging said latch member toward said latching position.

3. A tool according to claim 2, wherein said spring has a coiled portion, a first arm bearing against said housing and a second arm bearing against said latch member.

4. A tool according to claim 2, wherein said latching force is applied by said spring in a latching direction, and wherein said latching member includes an indicator visible exterior of said housing for guiding application of a releasing force in a releasing direction opposite to said latching direction.

5. A tool according to claim 1, wherein said housing has a closed end opposite said open end, and wherein said closed end defines a concave surface whereby said tool can be supported by said repair tool and said concave surface defines a rest for a golf club handle.

6. A tool according to claim 1, wherein said housing further defines an exterior opening slot for slidably receiving a disk member, and a contact member laterally biased into said slot so as to apply a holding force to said disk member in said slot.

7. A tool according to claim 6, wherein said disk member has at least one surface and an indentation on said surface, and wherein said contact member has an engaging member for positioning in said indentation to hold said disk member in said exterior opening slot.

8. A tool according to claim 7, wherein said housing further includes at least one protruding member positioned to rest against an edge of said disk member in said exterior opening slot.

9. The device according to claim 6, wherein said disk member has a surface and an indentation in said surface, and wherein said contact member further includes an engaging member positioned to engage said indentation to hold said disk member in said slot.

10. The device according to claim 6, further comprising at least one protruding member positioned to rest against an edge of said disk member in said slot.

11. A tool according to claim 1, wherein said repair tool has two extending prongs defining a space therebetween.

12. A tool according to claim 1, wherein said housing has an inner component formed of a first material and an outer component formed of a Second material wherein said second material is softer than said first material.

13. A ball-mark repair tool, comprising:

a housing having a longitudinal slot and an open end;

a repair tool having an operative end and being slidably positioned in the housing for sliding along a path between a withdrawn position and an extending position, said operative end extending from said open end of said housing in said extending position;

a latch member associated with said repair tool for sliding along said path with said repair tool and extending through said slot for manually moving said repair tool, said latch member further being positionable, when said repair tool is in said extending position, between a latching position wherein said repair tool is held in said extending position and a released position wherein said repair tool can be moved along said path to said withdrawn position;

further comprising a spring member disposed in said housing and applying a closing force for urging said repair tool toward said withdrawn position and applying a latching force for urging said latch member toward said latching position, wherein said spring has a coiled portion, a first arm bearing against said housing and a second arm bearing against said latch member, and wherein said housing further includes a post member disposed in said housing, said coiled portion being position around said post member.

14. A tool according to claim 13, wherein said latch member is moveable relative to said housing and said repair tool between said latching position and said released position.

15. A tool according to claim 13, wherein said spring applies a substantially constant force to said repair tool.

16. A ball-mark repair tool, comprising:

a housing having a longitudinal slot and an open end;

a repair tool having an operative end and being slidably positioned in the housing for sliding along a path between a withdrawn position and an extending position, said operative end extending from said open end of said housing in said extending position;

a latch member associated with said repair tool for sliding along said path with said repair tool and extending through said slot for manually moving said repair tool, said latch member further being positionable, when said repair tool is in said extending position, between a latching position wherein said repair tool is held in said extending position and a released position wherein said repair tool can be moved along said path to said withdrawn position, wherein said housing defines an inner stop surface and said latch member has a latching lug, and wherein said latching contacts said inner stop surface in said latching position.

17. A ball-mark repair tool, comprising:

a housing having a longitudinal slot and an open end;

a repair tool having an operative end and being slidably positioned in the housing for sliding along a path between a withdrawn position and an extending position, said operative end extending from said open end of said housing in said extending position;

a latch member associated with said repair tool for sliding along said path with said repair tool and extending through said slot for manually moving said repair tool, said latch member further being positionable, when said repair tool is in said extending position, between a latching position wherein said repair tool is held in said extending position and a released position wherein said repair tool can be moved along said path to said withdrawn position, wherein said latch member includes a first flange for sliding engagement with an outside surface of said housing, and a second flange spaced from said first flange for engagement with said repair tool.

* * * * *